US009816695B2

(12) United States Patent
Hsue et al.

(10) Patent No.: US 9,816,695 B2
(45) Date of Patent: Nov. 14, 2017

(54) LIGHT EMITTING DIODE LIGHT STRIP UNIT STRUCTURE

(71) Applicants: ShouWen Hsue, New Taipei (TW); Han-Sheng Chang, New Taipei (TW); Yu-Feng Chiu, New Taipei (TW)

(72) Inventors: ShouWen Hsue, New Taipei (TW); Han-Sheng Chang, New Taipei (TW); Yu-Feng Chiu, New Taipei (TW)

(73) Assignee: UBLeds Co., LTD., New Taipei (TW)

( * ) Notice: Subject to any disclaimer, the term of this patent is extended or adjusted under 35 U.S.C. 154(b) by 0 days.

(21) Appl. No.: 15/216,718

(22) Filed: Jul. 22, 2016

(65) Prior Publication Data

US 2016/0330812 A1 Nov. 10, 2016

(51) Int. Cl.

| | |
|---|---|
| ***H05B 33/08*** | (2006.01) |
| ***F21V 23/02*** | (2006.01) |
| ***F21S 4/22*** | (2016.01) |
| ***F21V 23/00*** | (2015.01) |

(52) U.S. Cl.

CPC ..... *F21V 23/02* (2013.01); *F21S 4/22* (2016.01); *F21V 23/005* (2013.01); *H05B 33/083* (2013.01); *H05B 33/0803* (2013.01); *H05B 33/086* (2013.01); *H05B 33/0812* (2013.01); *H05B 33/0827* (2013.01); *H05B 33/0857* (2013.01)

(58) Field of Classification Search

CPC ..... H05B 33/0803; H05B 33/083; H05B 37/0254; H05B 33/0827; H05B 33/04; H05B 33/0812; H05B 33/0857

See application file for complete search history.

(56) References Cited

U.S. PATENT DOCUMENTS

| | | | | |
|---|---|---|---|---|
| 6,777,891 | B2 * | 8/2004 | Lys | F21V 21/002 315/291 |
| 7,173,383 | B2 * | 2/2007 | Vornsand | H05B 33/0869 315/291 |
| 8,052,303 | B2 * | 11/2011 | Lo | F21V 5/00 315/185 R |
| 8,299,719 | B1 * | 10/2012 | Moshirnoroozi | H05B 33/0806 315/185 R |
| 8,567,992 | B2 * | 10/2013 | Lo | H05B 33/0803 315/312 |
| 2005/0213321 | A1 * | 9/2005 | Lin | H05B 33/0803 362/231 |

(Continued)

*Primary Examiner* — Douglas W Owens
*Assistant Examiner* — Borna Alaeddini

(57) ABSTRACT

A light emitting diode light strip unit structure is provided. The light emitting diode light strip unit structure includes an illuminating light strip unit which can be connected with an external power source and receive an external control signal independently as a light source. A plurality of illuminating light strip units are assembled and electrically connected with each other. Power supply voltage contacts and working voltage contacts of the illuminating light strip units are electrically connected with the power source to get working electricity. When grounding contacts of the illuminating light strip units complete the ground connection, signal output contacts and signal input contacts of the illuminating light strip units are electrically connected. One of the signal input contacts of the illuminating light strip units is predetermined to receive the control signal to form various types or forms (area) of light sources.

4 Claims, 6 Drawing Sheets

(56) References Cited

U.S. PATENT DOCUMENTS

| | | | | |
|---|---|---|---|---|
| 2006/0076901 | A1* | 4/2006 | Lin | H05B 33/0812 315/219 |
| 2009/0154156 | A1* | 6/2009 | Lo | F21V 5/00 362/234 |
| 2010/0220046 | A1* | 9/2010 | Plotz | F21K 9/00 345/102 |
| 2013/0147375 | A1* | 6/2013 | Williams | H05B 33/0827 315/192 |

* cited by examiner

LIGHT EMITTING DIODE LIGHT STRIP UNIT STRUCTURE

BACKGROUND OF THE INVENTION

1. Field of the Invention

The present invention relates to a light emitting diode light strip unit structure, and more particularly to a light strip unit used as a light source. The light strip unit can save the cost to drive the circuit and provide a stable voltage to illuminating members. The light strip unit can illuminate independently, which is beneficial for maintenance and repair.

2. Description of the Prior Art

With the rise of environmental awareness and energy-saving, the developments of various types of electronic devices gradually comply with the requirements environmental protection and energy-saving, especially for the requirement of lighting or a light source. The main reason is that lighting or a light source is indispensable in our life. Based on the concept of environmental protection and energy-saving, illuminating devices, such as traditional light tubes, light bulbs, and the like, are gradually replaced with LED lights. On the market, an LED light strip may be used alone or multiple LED light strips are assembled to form a variety of specifications or forms of light sources (in different lengths or different widths). The LED light strip is often used as a light source of lighting, backlight, or sidelight in different occasions. A conventional LED light strip is connected with an external driver (IC driver). The driver receives a control signal from a controller to drive the LEDs on the LED light strip. Since the light strip uses an LED chip as an illuminating member, its sensitivity to electrical property is very high. If the supply voltage is not stable, the LED chip is prone to burn up or may have the problems of light attenuation, scintillation, and so on. When the assembly of multiple light strips is used as a light source, it takes a lot of time and work. Although the external driver can mate with the power of the light strips, there are variations in different types or forms of the multiple light strips in different occasions. The distance for the driver to drive each LED chip via the drive circuit is different. Sometimes, the supply voltage to the LED is not stable. This will impact the quality of the light source. If the voltage is increased or decreased, the light may be burned up or have the problems of light attenuation, scintillation, and so on. When one of the light strips malfunctions, the function of the other light strips will be influenced. The related drive circuit must be checked for replacement of the light strip. This causes difficulties in maintenance. Accordingly, the inventor of the present invention has devoted himself based on his many years of practical experiences to solve these problems.

SUMMARY OF THE INVENTION

The primary object of the present invention is to provide a light emitting diode light strip unit structure. The light emitting diode light strip unit structure comprises an illuminating light strip unit. The illuminating light strip unit comprises a base strip, a plurality of illuminating members, and a drive illuminating member. The base strip is made of an insulation material and provided with a conducting circuit thereon. Two ends of the conducting circuit are provided with at least one power supply voltage contact, a working voltage contact, a signal input contact, a signal output contact, and a grounding contact on the base strip. The illuminating members each comprise at least one light emitting diode disposed on the base strip. The illuminating members are connected with the conducting circuit in series to get supply voltage through the power supply voltage contact. The drive illuminating member comprises at least one built-in LED illuminating chip and a built-in IC drive chip. The LED illuminating chip and the illuminating members are connected in series through the conducting circuit. The IC drive chip is electrically connected with the LED illuminating chip as a drive circuit of the LED illuminating chip and the illuminating members. Through the conducting circuit, the working voltage contact gets working electricity, the signal input contact receives an external control signal, the signal output contact sends the control signal out, and the grounding contact and a power source form a ground loop. The illuminating light strip unit can be connected with the power source and receive the control signal independently as a light source. A plurality of illuminating light strip units are assembled and electrically connected with each other. The power supply voltage contacts and the working voltage contacts of the illuminating light strip units are electrically connected with the external power source to get working electricity. When the grounding contacts of the illuminating light strip units complete the ground connection, the signal output contacts and the signal input contacts of the illuminating light strip units are electrically connected. One of the signal input contacts of the illuminating light strip units is predetermined to receive the control signal to form various types or forms (area) of light sources. Each illuminating light strip unit has the built-in IC drive chip of the drive illuminating member thereon to drive the illuminating members at a short distance for forming various types or forms of light sources. This way saves the cost to drive the circuit and enables each illuminating member to work under a stable working voltage so as to provide a better light source. The illuminating light strip units are assembled to complete various types or forms of light sources. Each of the illuminating light strip units can illuminate independently. It is convenient to repair each illuminating light strip unit. The present invention is cost-effective.

Preferably, the base strip is made of a flexible insulation material. Through the flexibility of the base strip, one or more illuminating light strip units are used as a light source of sidelight, backlight or illumination on various curved surfaces. The base strip may be made of a flexible PI (polyimide) or PET (polyethylene terephthalate plastic) material. The conducting circuit is formed on the base strip by copper etching, such that the illuminating members and the drive illuminating member are disposed on and electrically connected with the conducting circuit in series.

Preferably, the conducting circuit on the base strip is provided with three power supply voltage contacts. Each of the illuminating members is provided with three built-in red, green and blue light emitting diodes. The illuminating members are connected in series through the conducting circuit. The three built-in light emitting diodes get supply voltage through the three power supply voltage contacts. The drive illuminating member is provided with three built-in red, green and blue LED illuminating chips connected with the three light emitting diodes of each illuminating member in series. Three drive contacts of the IC drive chip are electrically connected with the three LED illuminating chips respectively as the drive circuit of the three LED illuminating chips and the illuminating members. The three built-in red, green and blue light emitting diodes of each illuminating member and the three built-in red, green and blue LED illuminating chips of the drive illuminating member can be set and driven by the IC drive chip to change the color of illumination. One or more illuminating light strip units are assembled as a light source. The color of the light source can be set or changed according to the demand or condition of the environment or occasion.

DETAILED DESCRIPTION OF THE PREFERRED EMBODIMENTS

Embodiments of the present invention will now be described, by way of example only, with reference to the accompanying drawings.

Figure 1:
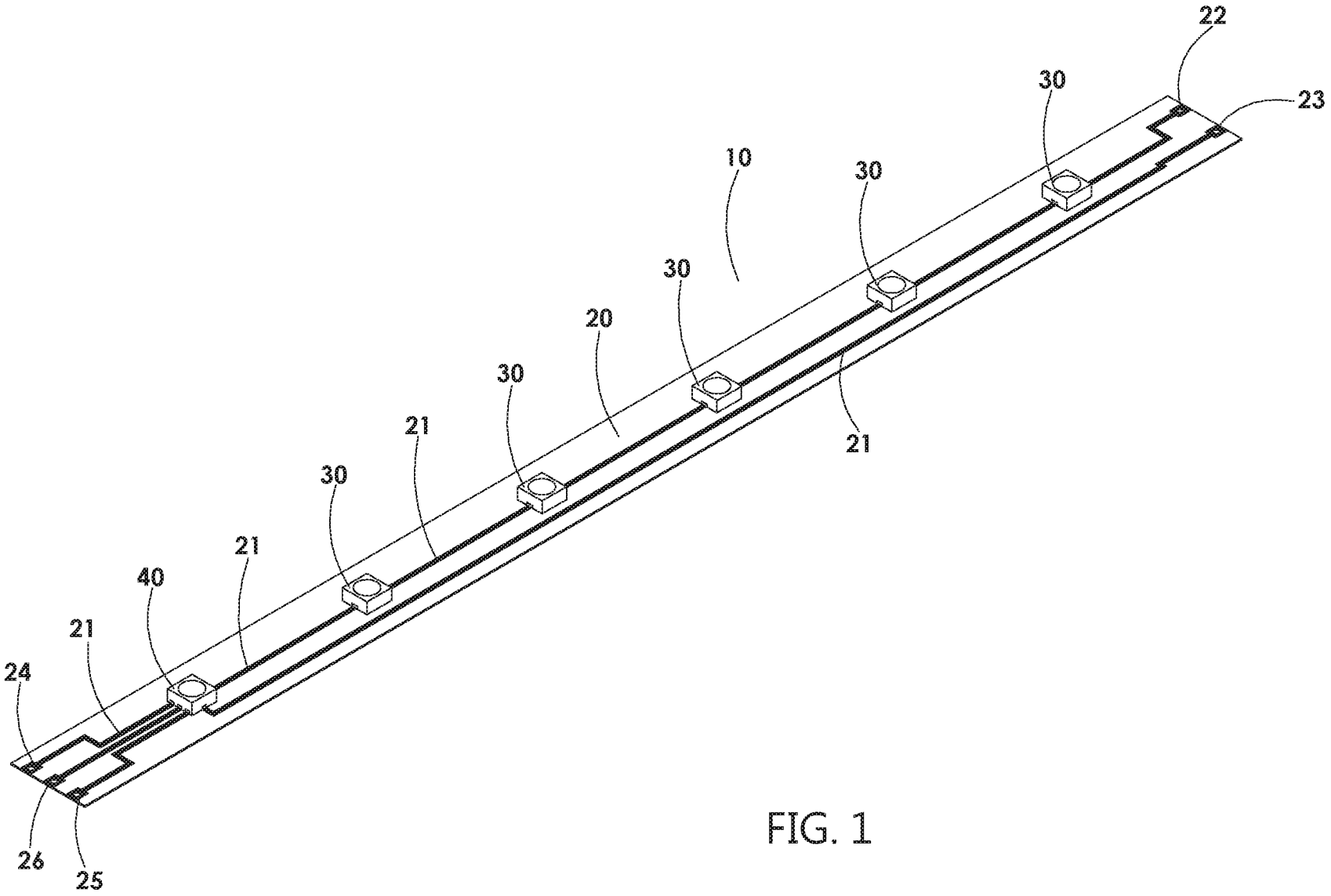
FIG. 1 is a perspective view according to a first embodiment of the present invention.
Figure 2:
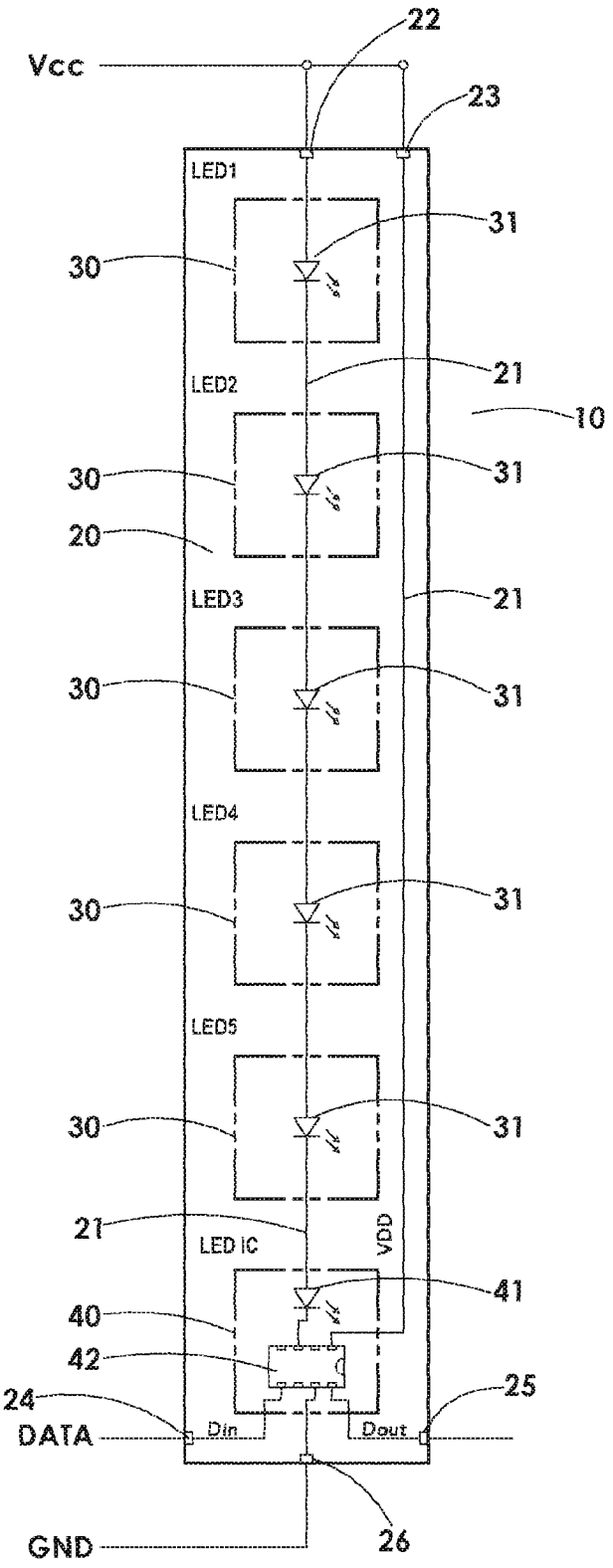
FIG. 2 is a circuit diagram according to the first embodiment of the present invention.
Figure 3:
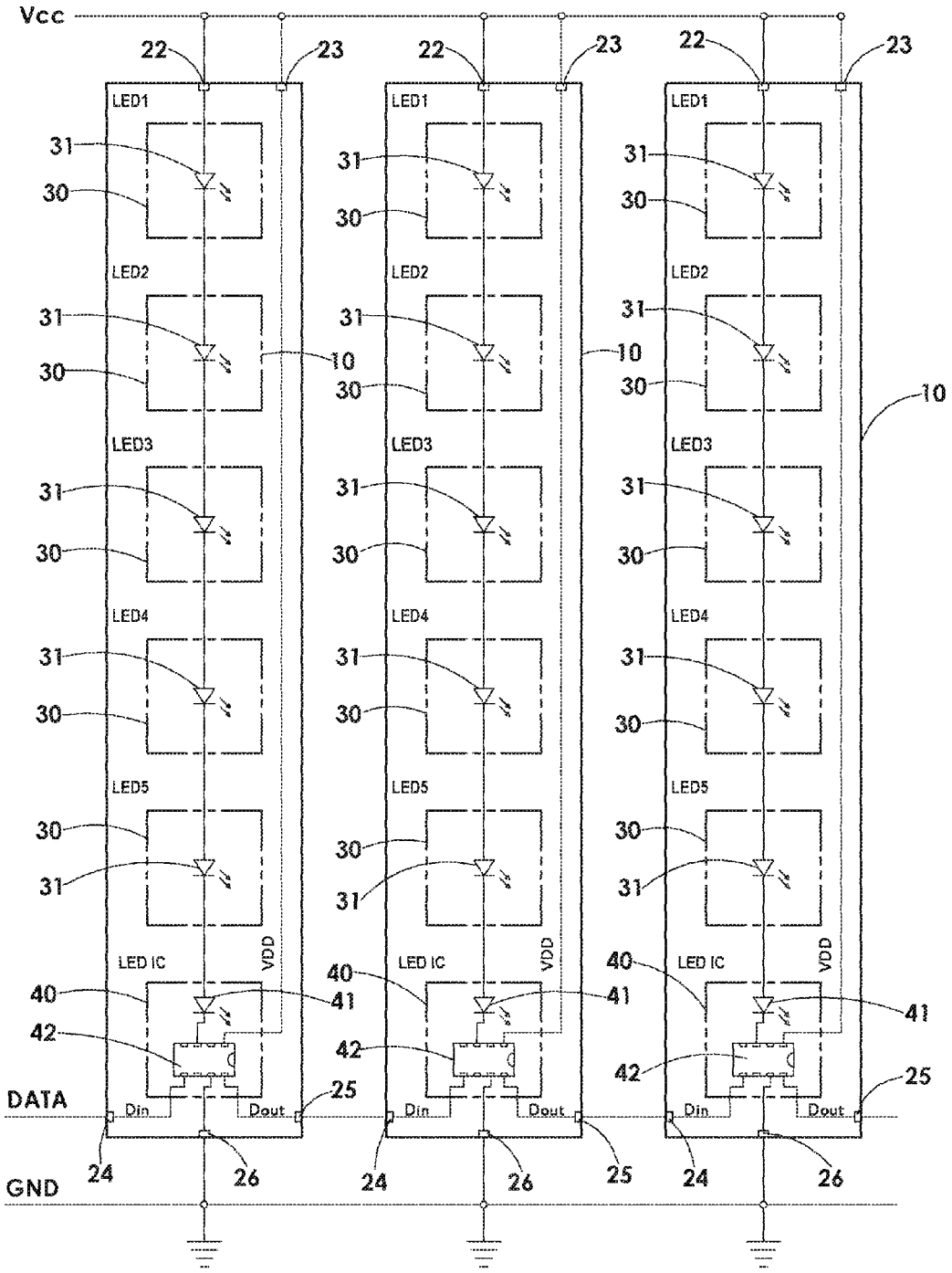
FIG. 3 is a circuit diagram of the assembly of multiple illuminating light strip units according to the first embodiment of the present invention.

As shown in FIG. 1 and FIG. 2, the present invention discloses a light emitting diode light strip unit structure comprises an illuminating light strip unit 10. The illuminating light strip unit 10 comprises a base strip 20, a plurality of illuminating members 30, and a drive illuminating member 40. The base strip 20 is made of an insulation material and provided with a conducting circuit 21 thereon. Two ends of the conducting circuit 21 are provided with at least one power supply voltage contact 22, a working voltage contact 23, a signal input contact 24, a signal output contact 25, and a grounding contact 26 on the base strip 20. The illuminating members 30 (LEDs 1-5) each comprise at least one light emitting diode (LED) 31 disposed on the base strip 20. The illuminating members 30 are connected with the conducting circuit 21 in series to get supply voltage through the power supply voltage contact 22 to connect an external power source. The drive illuminating member (LED IC) 40 comprises at least one built-in LED illuminating chip 41 and a built-in IC drive chip 42. The LED illuminating chip 41 and the LEDs 31 of the illuminating members 30 are connected in series through the conducting circuit 21. The IC drive chip 42 is electrically connected with the LED illuminating chip 41 as a drive circuit of the LED illuminating chip 41 and the illuminating members 30 (the LEDs 31). Through the conducting circuit 21, the working voltage contact 23 gets working electricity, the signal input contact 24 receives an external control signal, the signal output contact 25 sends the control signal out, and the grounding contact 26 and the power source form a ground loop. The illuminating light strip unit 10 can be connected with the power source and receive the control signal independently as a light source. As shown in FIG. 3, a plurality of illuminating light strip units 10 are provided and electrically connected with each other. The power supply voltage contacts 22 and the working voltage contacts 23 of the illuminating light strip units 10 are electrically connected with the external power source to get working electricity. When the grounding contacts 26 of the illuminating light strip units 10 complete the ground connection, the signal output contacts 25 and the signal input contacts 24 of the illuminating light strip units 10 are electrically connected. One of the signal input contacts 24 of the illuminating light strip units 10 is predetermined to receive the control signal to form various types or forms (area) of light sources. Each illuminating light strip unit 10 has the built-in IC drive chip 42 of the drive illuminating member 40 thereon to drive the LED illuminating chip 41 and the LEDs 31 of the illuminating members 30 on the base strip 20 at a short distance for forming various types or forms of light sources. This way saves the cost to drive the circuit and enables each LED 31 of the illuminating members 30 and the LED illuminating chip 41 of the drive illuminating member 40 to work under a stable working voltage so as to provide a better light source. The illuminating light strip units 10 are assembled to complete various types or forms of light sources. Each of the illuminating light strip units 10 can illuminate independently. It is convenient to repair each illuminating light strip unit 10. The present invention is cost-effective.

According to the foregoing embodiment, as shown in FIG. 1, the base strip 20 is made of a flexible insulation material. Through the flexibility of the base strip 20, one or more illuminating light strip units 10 can be used as a light source of sidelight, backlight or illumination on various curved surfaces. The base strip 20 may be made of a flexible PI (polyimide) or PET (polyethylene terephthalate plastic) material. The conducting circuit 21 is formed on the base strip 20 by copper etching, such that the illuminating members 30 and the drive illuminating member 40 are disposed on and electrically connected with the conducting circuit 21 in series.

Figure 4:
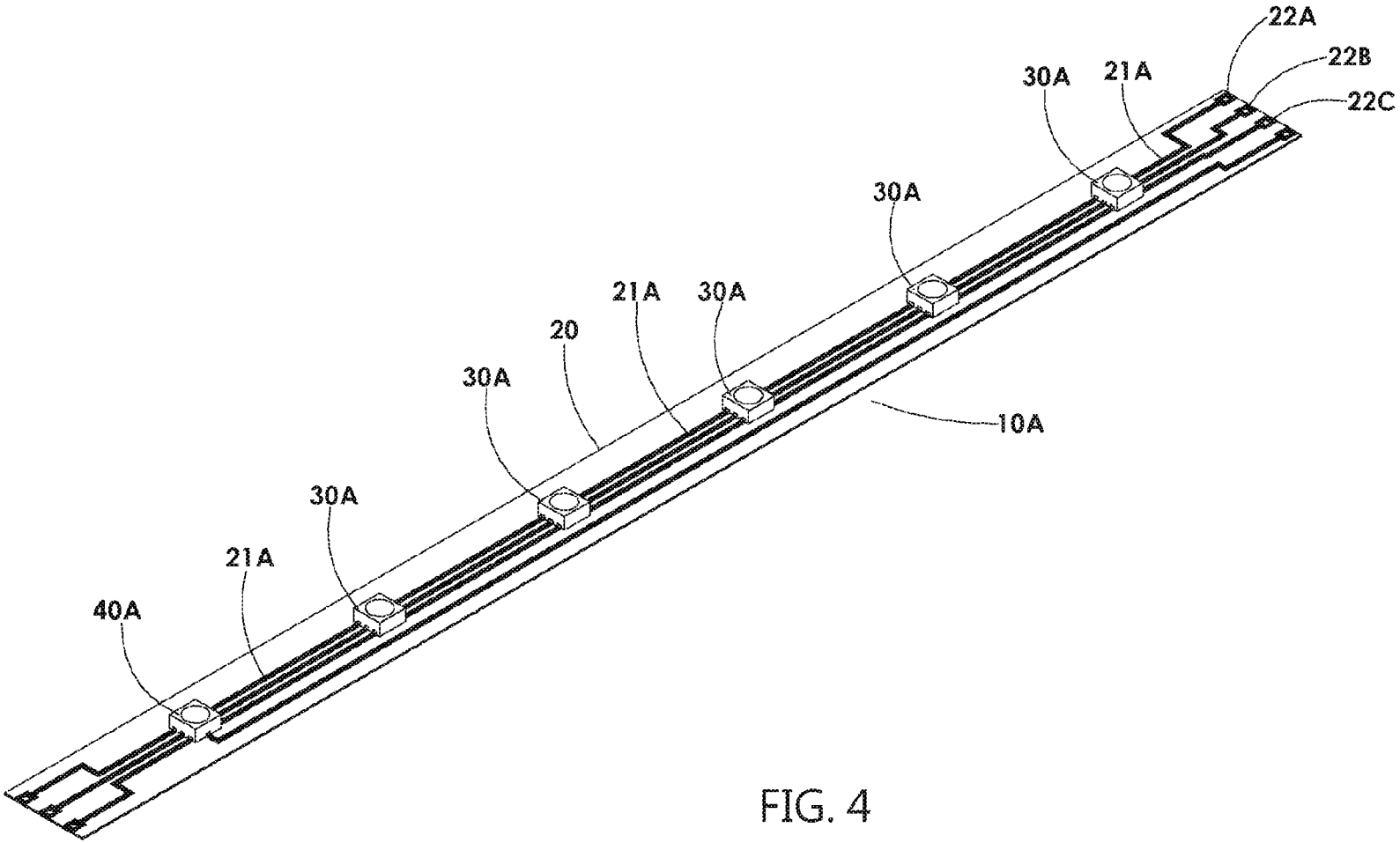
FIG. 4 is a perspective view according to a second embodiment of the present invention.
Figure 5:
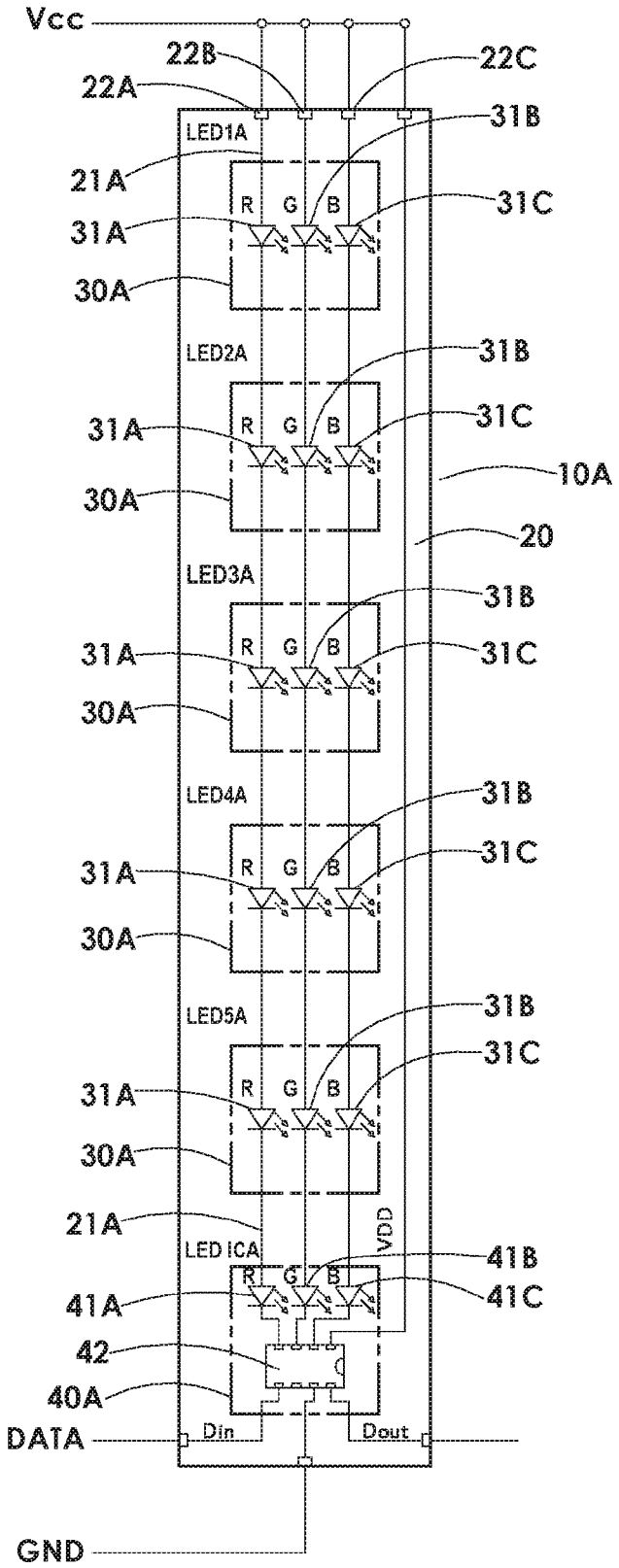
FIG. 5 is a circuit diagram according to the second embodiment of the present invention.
Figure 6:
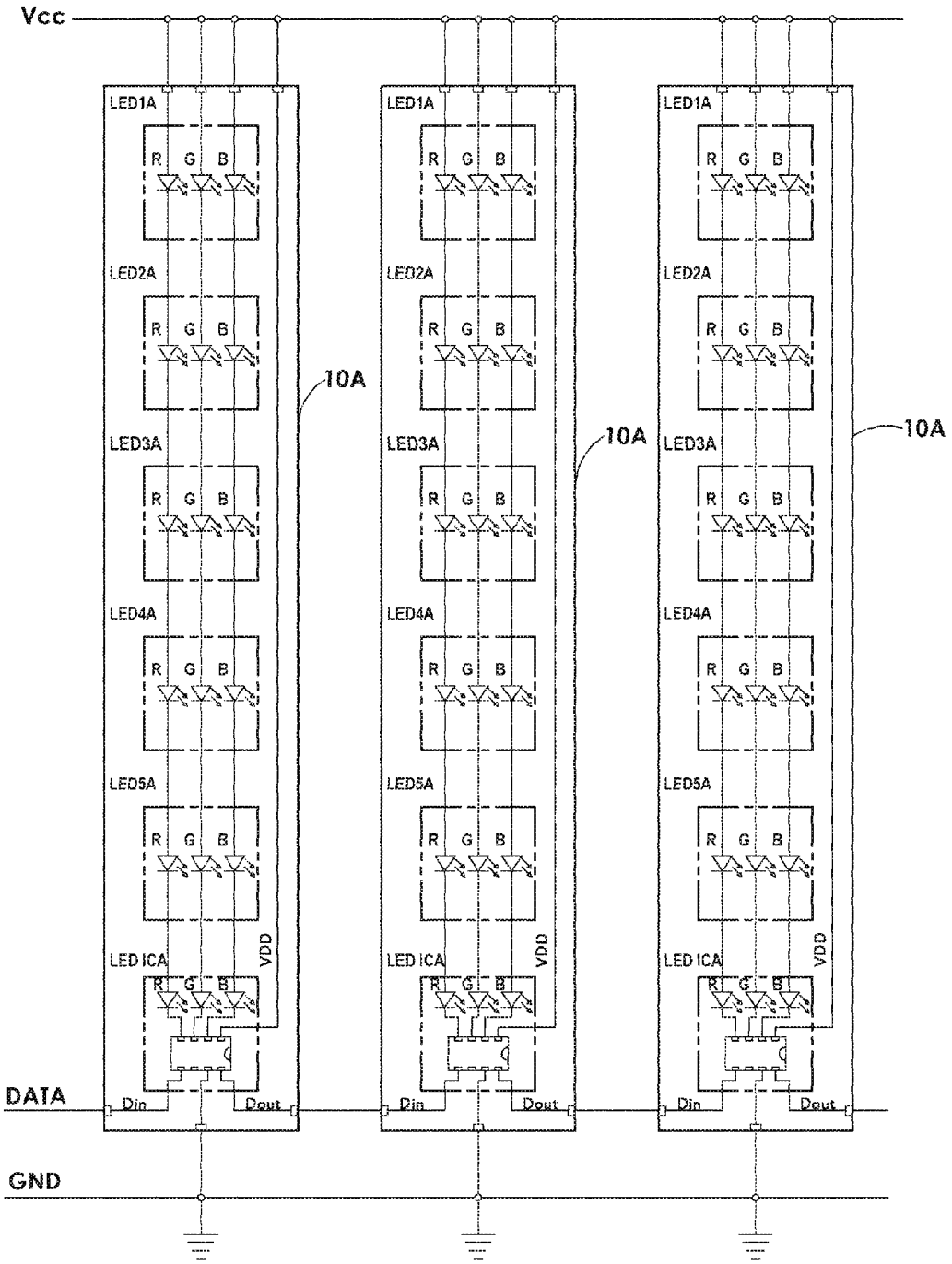
FIG. 6 is a circuit diagram of the assembly of multiple illuminating light strip units according to the second embodiment of the present invention.

According to the foregoing embodiment, as shown in FIG. 4 and FIG. 5, the conducting circuit 21A on the base strip 20 is provided with three power supply voltage contacts 22A, 22B, 22C. Each of the illuminating members 30A is provided with three built-in red, green and blue light emitting diodes 31A, 31B, 31C. The illuminating members 30A are connected in series through the conducting circuit 21A. The three built-in light emitting diodes 31A, 31B, 31C get supply voltage through the three power supply voltage contacts 22A, 22B, 22C. The drive illuminating member 40A is provided with three built-in red, green and blue LED illuminating chips 41A, 41B, 41C connected with the three light emitting diodes 31A, 31B, 31C of each illuminating member 30A in series. Three drive contacts of the IC drive chip 42 are electrically connected with the three LED illuminating chips 41A, 41B, 41C respectively as the drive circuit of the three LED illuminating chips 41A, 41B, 41C and the illuminating members 30A (the light emitting diodes 31A, 31B, 31C). The three built-in red, green and blue light emitting diodes 31A, 31B, 31C of each illuminating member 30A and the three built-in red, green and blue LED illuminating chips 41A, 41B, 41C of the drive illuminating member 40A can be set and driven by the IC drive chip 42 to change the color of illumination. As shown in FIG. 5 and FIG. 6, one or more illuminating light strip units 10 are assembled as a light source. The color of the light source can be set or changed according to the demand or condition of the environment or occasion.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A light emitting diode light strip unit structure, comprising an illuminating light strip unit, the illuminating light strip unit comprising a base strip, a plurality of illuminating members, and a drive illuminating member; the base strip being made of an insulation material and provided with a conducting circuit thereon, two ends of the conducting circuit being provided with at least one power supply voltage contact, a working voltage contact, a signal input contact, a signal output contact, and a grounding contact disposed on the base strip; the illuminating members each comprising at least one light emitting diode disposed on the base strip, the illuminating members being connected with the conducting circuit in series to get supply voltage through the power supply voltage contact; the drive illuminating member comprising at least one built-in LED illuminating chip and a built-in IC drive chip, the LED illuminating chip and the illuminating members being connected in series through the conducting circuit, the IC drive chip being electrically connected with the LED illuminating chip as a drive circuit of the LED illuminating chip and the illuminating members, through the conducting circuit, the working voltage contact getting working electricity, the signal input contact receiving an external control signal, the signal output contact sending the control signal out, and the grounding contact and a power source forming a ground loop; the illuminating light strip unit being connected with the power source and receiving the control signal independently as a light source; a plurality of illuminating light strip units being assembled and electrically connected with each other, the power supply voltage contacts and the working voltage contacts of the illuminating light strip units being electrically connected with the power source to get working electricity, when the grounding contacts of the illuminating light strip units complete a ground connection, the signal output contacts and the signal input contacts of the illuminating light strip units being electrically connected, one of the signal input contacts of the illuminating light strip units being predetermined to receive the control signal to form various types or forms of light sources; each illuminating light strip unit having the built-in IC drive chip of the drive illuminating member thereon to drive the illuminating members at a short distance.

2. The light emitting diode light strip unit structure as claimed in claim 1, wherein through flexibility of the base strip, one or more illuminating light strip units are used as a light source of sidelight, backlight or illumination on various curved surfaces.

3. The light emitting diode light strip unit structure as claimed in claim 2, wherein the base strip is made of a flexible PI (polyimide) or PET (polyethylene terephthalate plastic) material, the conducting circuit is formed on the base strip by copper etching, such that the illuminating members and the drive illuminating member are disposed on and electrically connected with the conducting circuit in series.

4. The light emitting diode light strip unit structure as claimed in claim 1, wherein the conducting circuit on the base strip is provided with three power supply voltage contacts, each of the illuminating members is provided with three built-in red, green and blue light emitting diodes, the illuminating members are connected in series through the conducting circuit, the three built-in light emitting diodes get the supply voltage through the three power supply voltage contacts, the drive illuminating member is provided with three built-in red, green and blue LED illuminating chips connected with the three light emitting diodes of each illuminating member in series, three drive contacts of the IC drive chip are electrically connected with the three LED illuminating chips respectively as the drive circuit of the three LED illuminating chips and the illuminating members, the three built-in red, green and blue light emitting diodes of each illuminating member and the three built-in red, green and blue LED illuminating chips of the drive illuminating member are set and driven by the IC drive chip to change colors of illumination.

* * * * *